United States Patent [19]

Grenier et al.

[11] 4,330,308

[45] May 18, 1982

[54] PLATE-TYPE HEAT EXCHANGERS

[75] Inventors: Maurice Grenier, Paris; Pierre Petit, Chatenay-Malabry, both of France

[73] Assignee: L'Air Liquide, Societe Anonyme pour l'Etude et l'Exploitation des Procedes Georges Claude, Paris, France

[21] Appl. No.: 145,814

[22] Filed: May 1, 1980

[30] Foreign Application Priority Data

May 18, 1979 [FR] France ..... 79 12727

[51] Int. Cl.[3] ..... F25J 3/00

[52] U.S. Cl. ..... 62/40; 165/140

[58] Field of Search ..... 62/13–15, 62/40; 165/140

[56] References Cited

U.S. PATENT DOCUMENTS

| | | | |
|---|---|---|---|
| 3,256,704 | 6/1966 | Becker | 62/13 |
| 3,469,271 | 9/1969 | Ichihara et al. | 62/13 |
| 3,587,731 | 6/1971 | Hays | 62/40 |
| 3,855,810 | 12/1974 | Simon et al. | 62/40 |
| 4,112,700 | 9/1978 | Forg | 62/40 |

FOREIGN PATENT DOCUMENTS

| | | |
|---|---|---|
| 1152432 | 8/1963 | Fed. Rep. of Germany . |
| 1925480 | 11/1969 | Fed. Rep. of Germany . |
| 2053109 | 4/1971 | France . |
| 2384221 | 3/1977 | France . |

*Primary Examiner*—Norman Yudkoff

*Attorney, Agent, or Firm*—Young & Thompson

[57] ABSTRACT

This invention relates to heat exchangers comprising vertically arranged plates, and passages are provided which extend from an inlet casing to an outlet casing, as well as further passages which extend from a two-phase inlet casing to other outlet casings. Other passages for an auxiliary fluid extend between the latter casing outlet and an upper extremity of the heat exchanger.

Heat exchangers according to the invention can be used for the liquefaction of natural gas in particular.

23 Claims, 19 Drawing Figures

PLATE-TYPE HEAT EXCHANGERS

BACKGROUND OF THE INVENTION

The present invention relates to plate-type heat exchangers of the kind comprising a plurality of rectangular plates whose transverse dimension is the width of the exchanger and whose maximum longitudinal dimension is the length of the exchanger, said plates being stacked and joined together with sealed mutual spacings along the thickness of the exchanger to form at least:

(a) a plurality of first passages for the cooling of a refrigerating mixture, (b) a plurality of second passages for the cooling of a gas which is to be processed, said first and second passages having inlets at a first longitudinal extremity of the exchanger and outlets at least close to a second longitudinal extremity of the exchanger;

(c) a plurality of third passages for the heating of the refrigerating mixture, having inlets which are at least close to said second extremity of the exchanger and having outlets which are laterally arranged at a distance from said first exchanger extremity, and (d) a plurality of fourth passages situated in longitudinal extensions left free by said third passages, extending longitudinally from the outlet extremity of said third passages to said first extremity of the exchanger, the inlets and outlets of said fourth passages being arranged laterally with respect to the exchanger.

Hereinafter such heat exchangers will be referred to as "of the kind described".

It is an object of the invention to provide structural forms which are appropriate more particularly for an arrangement of the exchanger in accordance with which its greater dimension is situated vertically.

SUMMARY OF THE INVENTION

Accordingly, in heat exchangers of the kind described the invention consists in that the fourth passages comprise active heat exchange spaces having flow-guiding means directed longitudinally whose longitudinal extension is limited, thereby leaving free at either side of the active space on the one hand a supply distribution space comprising flow-guiding means and on the other hand a discharge distribution space comprising flow-guiding means, said supply and discharge distribution spaces comprising flow-guiding means leading respectively into the inlets and outlets of said fourth passages and leading to the one and the other of the transverse edges of the active heat exchange space.

BRIEF DESCRIPTION OF THE DRAWINGS

In order that the invention may be more clearly understood, reference will now be made to the accompanying drawings which show certain embodiments thereof by way of example and in which.

DETAILED DESCRIPTION OF PREFERRED EMBODIMENT

Figure 1:
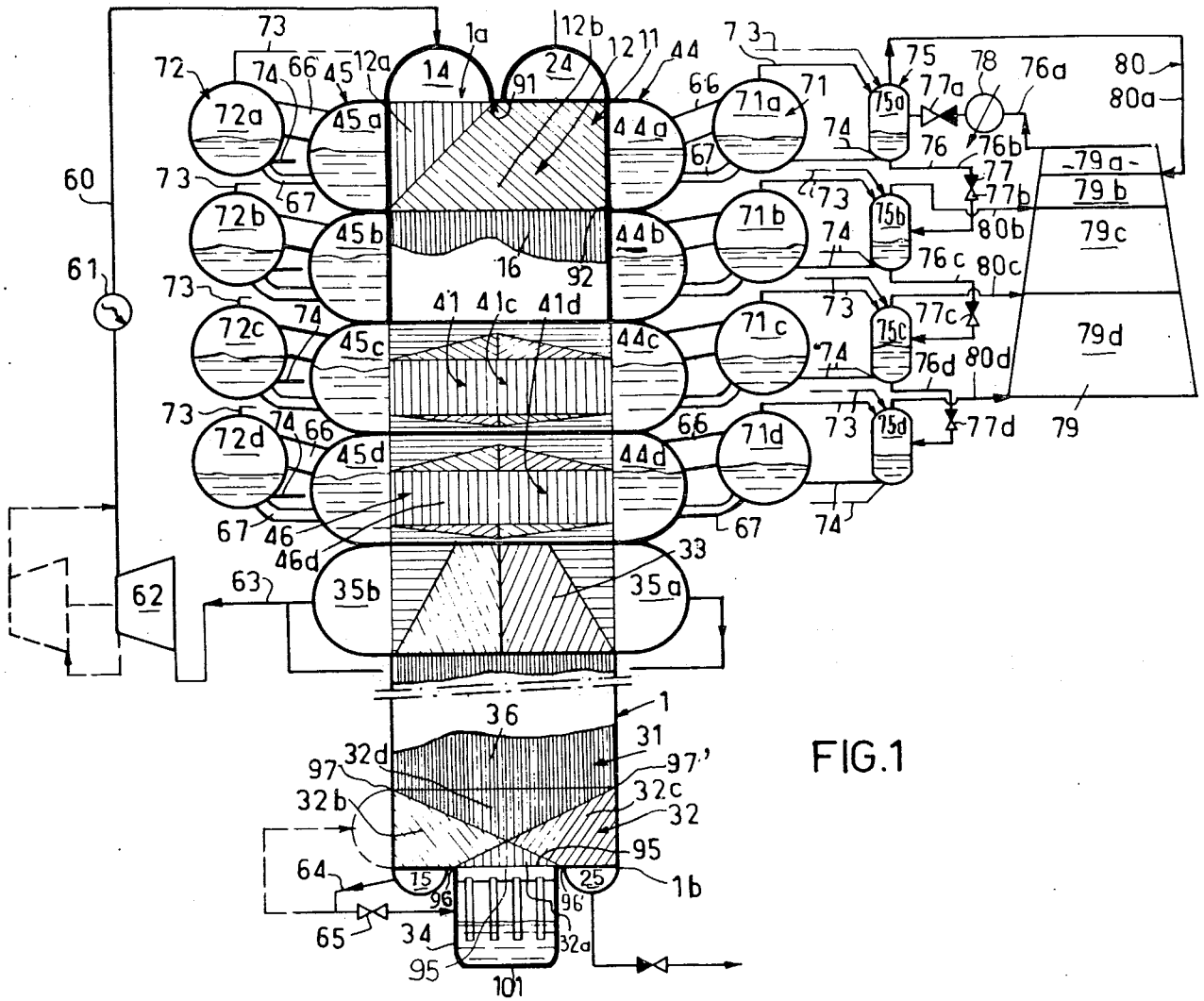
FIG. 1 is a diagrammatical view of a cryogenic processing plant comprising a heat exchanger in accordance with the invention, in vertical cross-section.
Figure 2:
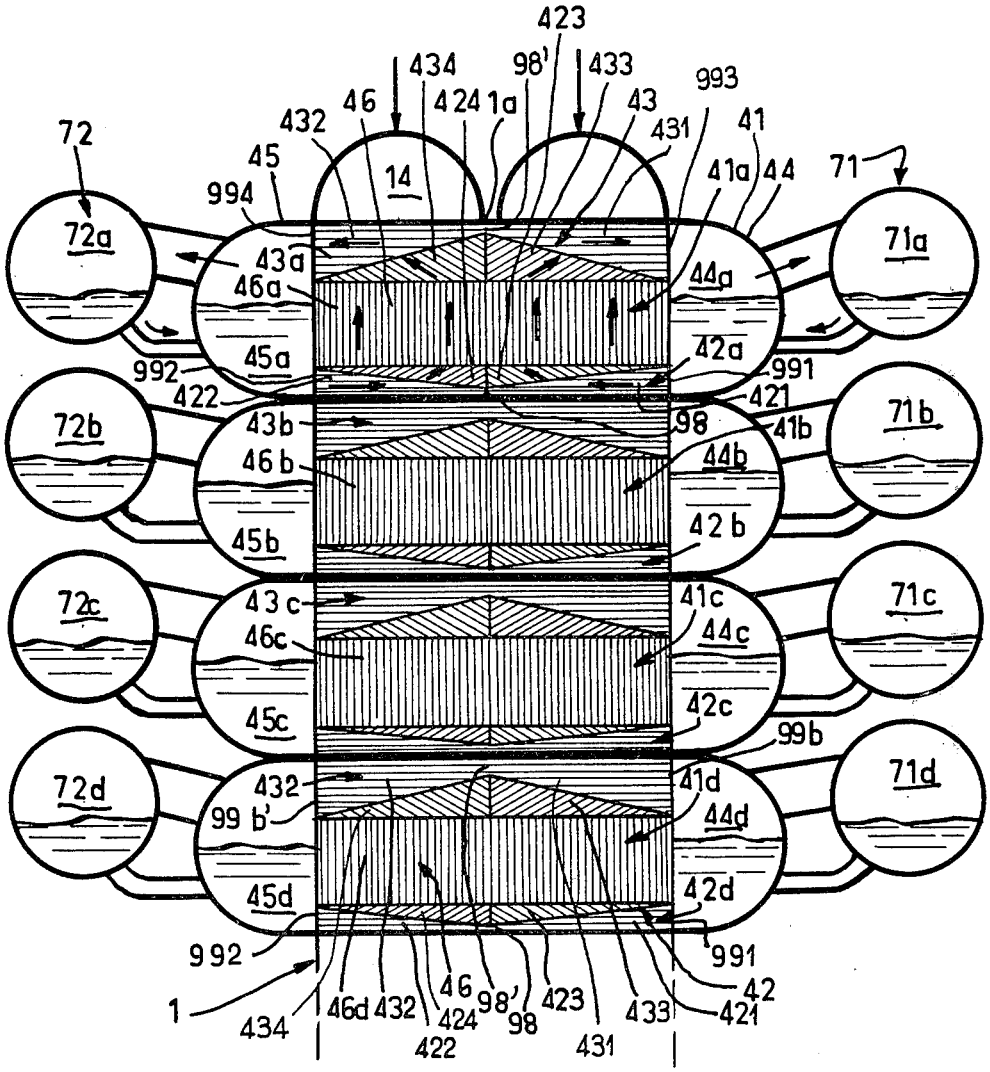
FIG. 2 is a more detailed view of the fourth passages of the heat exchanger shown in FIG. 1, FIGS. 3 to 7 are views in vertical cross-section of modified embodiments of the fourth passages of a heat exchanger in accordance with the invention.
Figure 12:
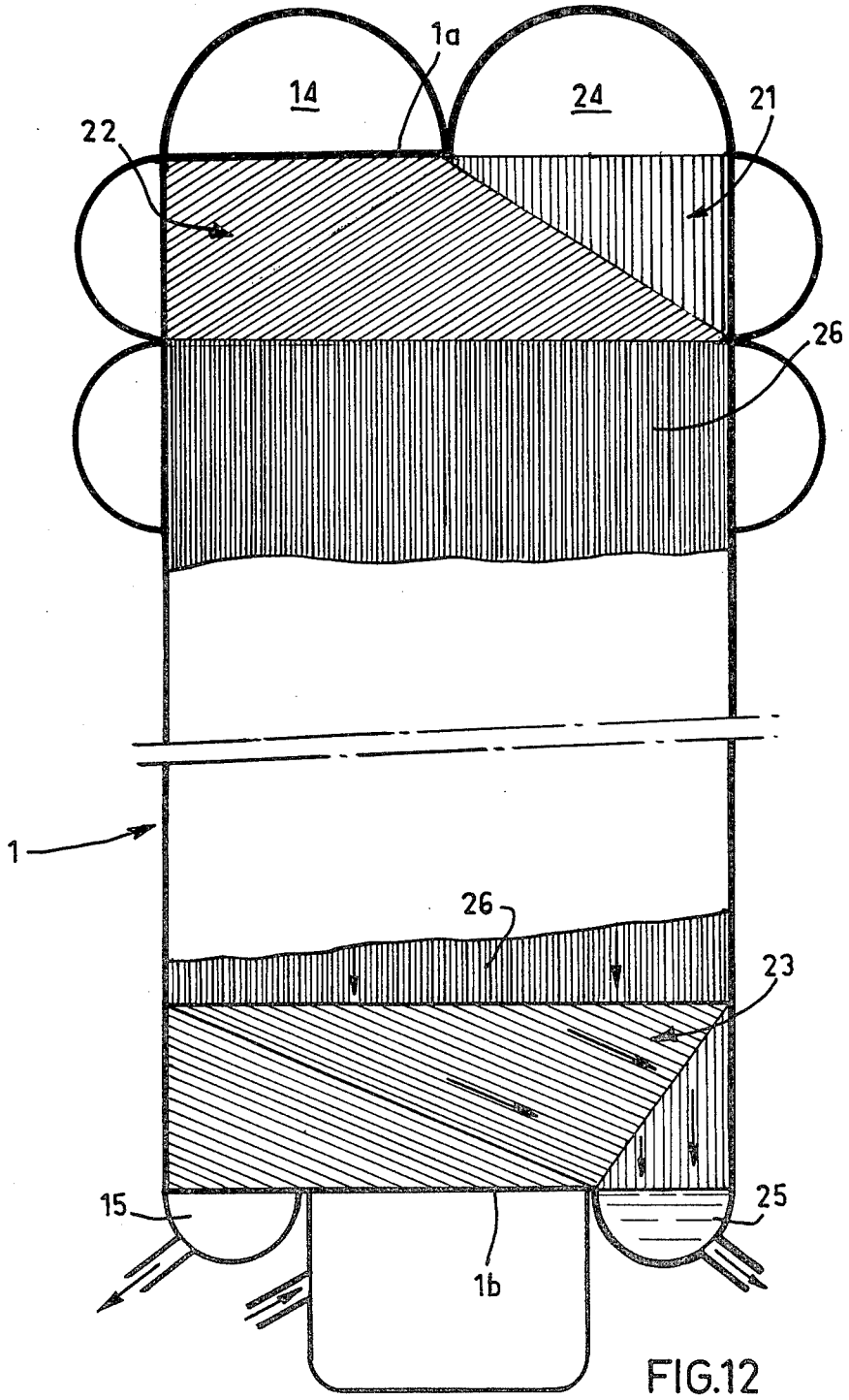
FIG. 12 is a partial view in vertical cross-section of an exchanger at right angles to a second passage.

Referring now to the drawings and firstly, to FIGS. 1, 2 and 12, a liquefying plant as shown therein comprises a plate-type exchanger 1 formed by a stack of rectangular plates whose larger dimension, or length or height is situated vertically from a first upper extremity 1*a* to a second lower extremity 1*b*, whereas the smaller dimensions, or width and thickness, are horizontal.

These plates are separated from each other by spacing bars, the whole being brazed together in such manner as to establish a plurality of heat exchange passages, as set forth below:

1. Referring more particularly to FIG. 1, a plurality of first heat exchange passages 11, or passages for the cooling of the refrigerating mixture, having a vertical extent throughout the length or height of the exchanger, comprising an active heat exchange space 16 extending from an upper inlet distribution space 12 to a lower outlet distribution space (not illustrated). The upper distribution space 12 itself is supplied via an upper inlet end casing 14 for the refrigerating mixture, whereas the lower outlet distribution space is in communication with a lower outlet end casing 15.
2. Referring more particularly to FIG. 12, a plurality of second heat exchange passages 21 or passages for cooling the gas processed, having substantially the same configuration, symmetrical about a median vertical plane, as the plurality of vertically extending passages 11, comprising an active heat exchange space 26 extending from a higher distribution space 22 to a lower distribution space 23. The higher distribution space 22 is supplied via a higher inlet end casing 24, whereas the lower distribution space 23 opens into a lower outlet end casing 25.
3. Referring more particularly to FIG. 1, a plurality of third passages 31 or passages for heating the refrigerating mixture, which are vertical, comprising an active heat exchange space 36 extending from a lower inlet distribution space 32 to a higher outlet distribution space 33, situated at an intermediate level along the height of the exchanger. The lower inlet distribution space 32 is in communication with a lower inlet end casing 34, whereas the higher outlet distribution space 33 is in communication with two lateral outlet casings 35*a* and 35*b*.
4. Referring more particularly to FIGS. 1 and 2, a plurality of fourth passages 41 for an auxiliary refrigerant, grouped into an assembly situated in the upper longitudinal extension of each of the third passages 31 for heating the refrigerating mixture, each of these fourth passages 41 itself being subdivided into a plurality (four in the example shown in the drawings) of sub-passages 41*a*, 41*b*, 41*c*, 41*d* having different pressures (four different pressures in the drawings), the pressure decreasing from an upper passage towards a lower passage and each of these passages 41 comprises an active heat exchange space 46 (46*a*, 46*b*, 46*c*, 46*d*) extending between a lower inlet distribution space 42 (42*a*, 42*b*, 42*c*, 42*d*) and a higher outlet distribution space 43 (43*a*, 43*b*, 43*c*, 43*d*), the inlet and outlet distribution spaces 42 and 43 being connected by double lateral common inlet-outlet casings 44 and 45 (44*a*, 44*b*, 44*c*, 44*d*; 45*a*, 45*b*, 45*c*, 45*d*).

The supply to the exchanger 1 will now be dealt with in detail with more particular reference to FIG. 1: the inlet casings 14 of the first passages 11 for the refrigerating mixture are connected via a pipe 60 incorporating a cooler 61 to the outlet of a compressor 62 having an inlet which is connected via a pipe 63 to the lateral outlet casings (35*a* and 35*b*) of the third passages 31. The inlet casing 34 of the passages 31 itself is connected via a pipe 64 incorporating an expansion valve 65 to the outlet casing 15 of the first passages 11. For example, the refrigerating mixture comprises hydrocarbons such as methane, ethane, butane and commonly nitrogen, and the feature of the process is that the refrigerating mixture reaches the inlet casing 14 in the purely gaseous state.

The second passages 21 intended for the gas in the course of being processed (commonly natural gas) are supplied via their inlet casing 24 with natural gas in the gaseous state at ambient temperature and the lower outlet casing 25 delivers liquefied natural gas. In known manner, the second passages may be provided with intermediate outlets and inlets situated laterally to provide elimination of particular components of the gas in the course of being processed.

The fourth passages 41 (41*a*, 41*b*, 41*c*, 41*d*) are connected via their inlet-outlet casings 44 and 45 on the one hand, via upper tubes 66 intended to convey vapour, if appropriate with liquid, and lower pipes 67 intended to carry liquid only, to a double series of lateral collectors 71 (71*a*, 71*b*, 71*c*, 71*d*) and 72(72*a*, 72*b*, 72*c*, 72*d*). These lateral collectors 71 and 72 themselves are connected via "vapour" pipes 73 and "liquid" pipes 74 to a separator 75 in each case (75*a*, 75*b*, 75*c*, 75*d*) equal in number to that of group of fourth sub-passages 41, operating under different pressures (that is to say four in the drawings), a separator 75, for example the separator 75*b*, being connected to the outlet of the "liquid" phase of the adjacent separator at higher pressure (75*a*) via a connecting pipe 76(76*b*, 76*c*, 76*d*) comprising an expansion valve 77 (77*b*, 77*c*, 77*d*), except for the top separator 75*a* under the highest pressure which is itself connected via a pipe 76*a* incorporating an expansion valve 77*a* and a cooler-condenser 78, to the outlet of a compressor 79 comprising several stages (79*a*, 79*b*, 79*c*, 79*d*) having inlets which are connected via pipes 80 (80*a*, 80*b*, 80*c*, 80*d*) to an upper extremity, respectively, of the separators (75*a*, 75*b*, 75*c*, 75*d*).

The different distribution spaces (12)-(22–23)-(32–33)-(42–43) of which some have novel structures, will now be described in particular.

Referring to FIGS. 1 and 12, the distribution spaces (12) and (22–23) have structures of identical type (the same applies in respect of the lower outlet distribution space of the first heat exchange passages 11 which is not illustrated), and a description of the distribution space 12 only, is consequently given. In each case, the inlet casings (14–24) or outlet casings (15–25) are situated at the axial extremity of the exchanger 1, but with a lateral stagger, in such manner that, at one and the same exchanger extremity, several inlet and/or outlet casings may be installed. The distribution space 12 comprises two sections 12*a*, 12*b*, formed from corrugated sheet metal; the section 12*a* has vertically extending corrugations, whereas the section 12*b* has parallel corrugations slopingly extending parallel to the direction connecting the inner edge 91 of the supply casing 14 and the lower corner 92 farthest from the distribution space 12. In this manner, the fluid, whether it is in the gaseous or liquid state (this fluid is specifically in the gaseous state however for the supply casing 14), is distributed evenly along the parallel corrugations of the section 12*a* and is then distributed along the parallel corrugations of the section 12*b* to penetrate evenly into the active heat exchange space 16 which is itself equipped with vertically extending parallel corrugations, which are commonly very narrow, to secure the maximum heat exchange effect.

Referring to FIG. 1, the particular structure of the inlet distribution space 32 and of the outlet distribution space 33 are now described in particular.

Each distribution space 32 has the feature that it has an inlet port 95 of the same depth as a passage 31 of the exchanger 1 and whose other dimension taken along the width of the exchanger 1 is reduced substantially by the presence of the outlet casing 15 for the refrigerating mixture and 25 for the gas processed. Moreover (which is however not of importance for definition of the structures of the distribution space 32), it is a two-phase fluid which passes through this supply port 95 in accordance with arrangements which will be considered further on.

This distribution space 32 is formed by four sections delimited by straight lines connecting the upper corners of the space 32 to the adjacent edges of the port 95. A first section 32*a* situated upstream along the fluid flow direction, thus appears in the form of a triangle the base of which co-extends with the port 95 and comprises vertically extending corrugations. Via its two sides, this first section 32*a* feeds two intermediate sections 32*b* and 32*c* provided with corrugations sloping along the direction connecting—in each section 32*b* or 32*c*—the lower edge 96 (96') of the section 32*a* adjacent to the section 32*a* to the upper edge 97' (97) adjacent to the distribution space 32.

A fourth distribution section 32*d* also appears in the form of a triangle the apex of which coincides with that of the section 32*a* and which is provided with vertically extending corrugations allowing of take-up of the fluid issuing from the sections 32*b* and 32*c* for uniform supply to the whole of the vertically extending corrugations of the active heat exchange space 36.

Referring to FIG. 2, a more particular description is now given of the form of the inlet and outlet distribution spaces 42 and 43 of each of the fourth passages 41 intended for vaporisation of an auxiliary refrigerant, commonly being propane; these distribution spaces each have two upstream sections 421 and 422 at the inlet and two upstream sections 431 and 432 at the outlet, in the form of comparatively flattened triangles or trapeziums and the apex or small sides of which face each other at the level of their apices or small sides 98—98', with inlet ports 991, 992 and outlet ports 993 and 994 in the inlet-outlet casings 44 and 45.

These sections 421 and 422 (431, 432) have horizontally extending corrugations which feed (or are fed by) a third distribution section 423, 424 (433,434) formed by a double sub-section each of which is formed by sloping corrugations converging towards the active heat exchange space 46 for the inlet (or divergent from this exchange space 46 for the outlet), in such manner as to take up the fluid coming from the sections 421 and 422 (or coming from the heat exchange space 46, respectively), to distribute the same uniformly throughout the length of the active heat exchange space 46 (or in the sections 431, 432, respectively).

It will be observed that the inlet ports 991 and 992 at the level of the liquid and the outlet ports 993 and 994 at the level of the vapour have different longitudinal extends, since the "vapour" outlet ports 993 and 994 are distinctly more elongated than the "liquid" inlet ports 991 and 992, which is explained by the fact that they should pass the same quantities of fluid as the "liquid" ports 991 and 992, but in the partially vapourised state, whereas the ports 991 and 992 allow the fluid to pass solely in the form of liquid.

Referring to FIGS. 1 and 2 at this juncture, an auxiliary refrigerant, for example propane, is fed in during operation in continuous manner into the lateral collectors 71 and 72 via the "liquid" pipes 74, and after being distributed into the casings 44 and 45, this liquid penetrates via the ports 991 and 992 into the sections 421 and 422 of the supply distribution space 42, before being taken up by the sub-sections 423 and 424 for distribution throughout the active heat exchange space 46 formed by vertically extending narrow corrugations.

The liquid auxiliary refrigerant is vapourised partially in these corrugations and flows through the sub-sections 433 and 434 of the distribution space 43, reaches the sections 431 and 432, then again being directed into the casings 44 and 45 and then into the lateral collectors 71 and 72.

The "vapour" fraction in the collectors 71 and 72 is directed (whilst nevertheless entraining a part of the incompletely decanted liquid) towards the separators under different pressures 75*a*, 75*b*, 75*c*, 75*d* in which the liquid droplets entrained are deposited in the said separators together with the liquid fraction.

The operation of these separators is well known and therefore will not be repeated herein. Suffice it to recall that the different "vapour" fractions of the separators 75 are returned to the different stages of the compressor 79, whereas the total delivery of the compressor 79 is first cooled and condensed in the cooler-condenser 78, then undergoes a first expansion in 77*a* before reaching the separator 75*a*, the liquid fraction of which is partially drawn via the pipe 76*b* towards an expansion valve 77*b* before being fed into the second separator 75*b*, and so forth.

Figure 3:
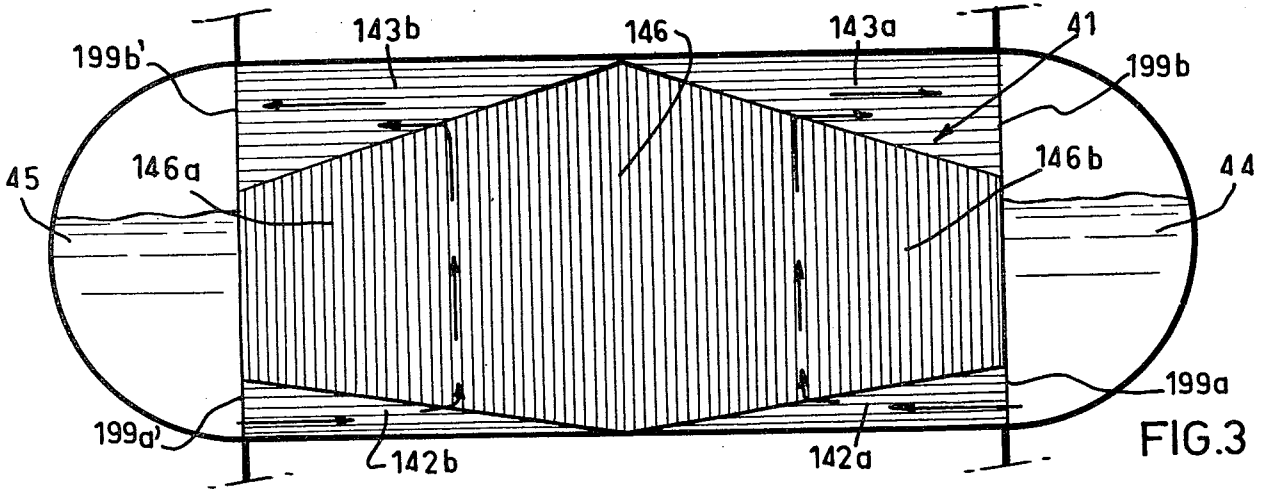

Reference is now made to FIG. 3 which relates to a modified embodiment of the fourth passages 41 for the auxiliary refrigerant. In this embodiment, the fourth passages 41 incorporate an active heat exchange space 146 which is formed by a trapezoidal double section 146*a* and 146*b*, the longer sides of which coincide and correspond to the longitudinal height of a passage 41.

The "liquid" inlet sections 142*a* and 142*b* have the form of flattened right-angled triangles whose shorter sides form inlet ports 199*a* and 199*a'* for the liquid, whereas the outlet sections 143*a* and 143*b* have the same form but have outlet ports 199*b* and 199*b'* of distinctly more elongated form in the longitudinal direction.

It will be observed that, in this case, the corrugations of the sections 146*a* and 146*b* of the active heat exchange space 46 are all vertical and these corrugations may have an ever narrower pitch in step with the approach to the casings 44 and 45, in such manner as to offer substantially identical pressure losses to the fluid despite the sizable differences in path lengths, as is clearly apparent from the drawings.

Figure 4:
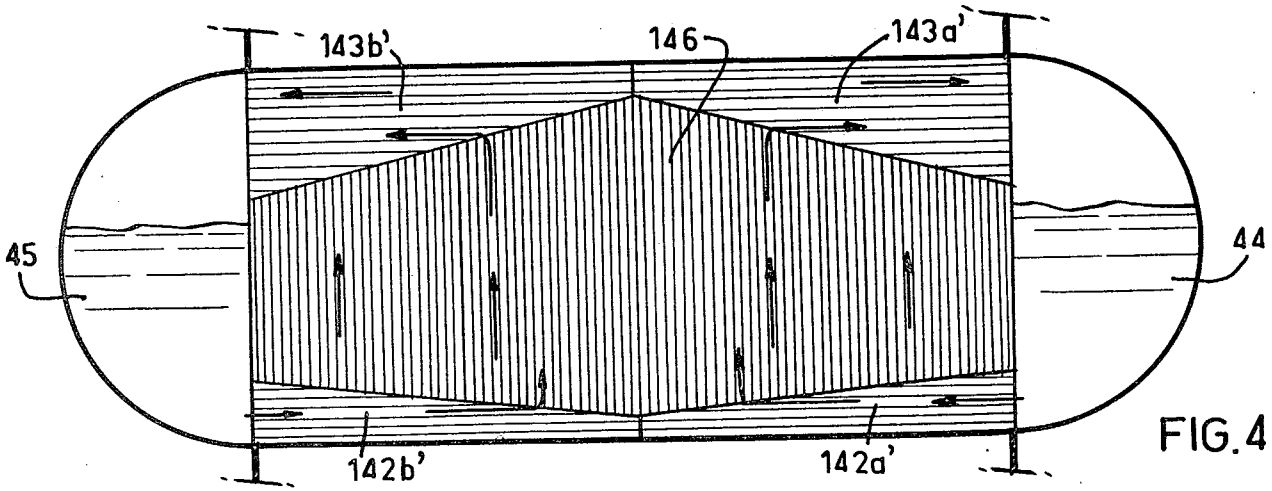

With reference to FIG. 4, this embodiment differs essentially from that depicted in FIG. 3, by the fact that the inlet sections (142*a'* and 142*b'*) and the outlet sections (143*a'* and 143*b'*) no longer have the form of triangles in this case, but of right-angled trapeziums.

Figure 5:
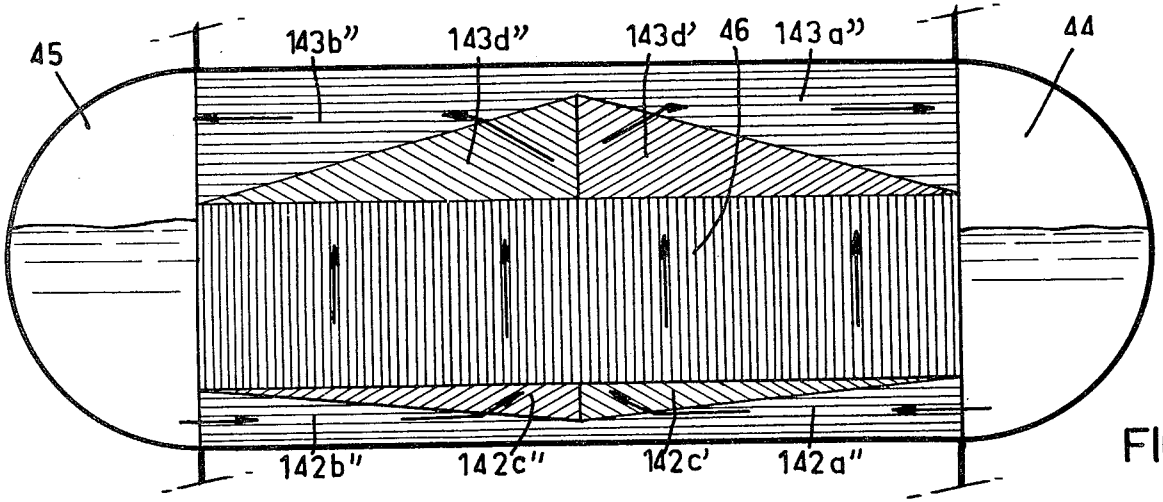

FIG. 5 differs from FIG. 4 in that the active heat exchange space 46 in this case has a rectangular form of lesser longitudinal extent and inlet sections 142*a''* and 142*b''* which have the same form as the sections 142*a'* and 142*b'* of FIG. 4, but these sections precede two connecting sections 142*c'* and 142*c''*, adjacent to the active space 46.

A substantially analogous arrangement is provided for the outlet distribution space in which the outlet sections 143'' and 143*b''* are preceded by connecting sections 143*d'* and 143*d''*. The connecting sections 142*c'* and 142*c''* have corrugations sloping in such manner as to distribute the fluid coming from the sections 142*a''* and 142*b''* throughout the inlet of the active heat exchange space 46, whereas the connecting sections 143*d'* and 143*d''* have the purpose of taking up the liquid in the two-phase state from the outlet of the active heat exchange section 46 and ducting the same to the outlet sections 143*a''* and 143*b''*.

Figure 6:
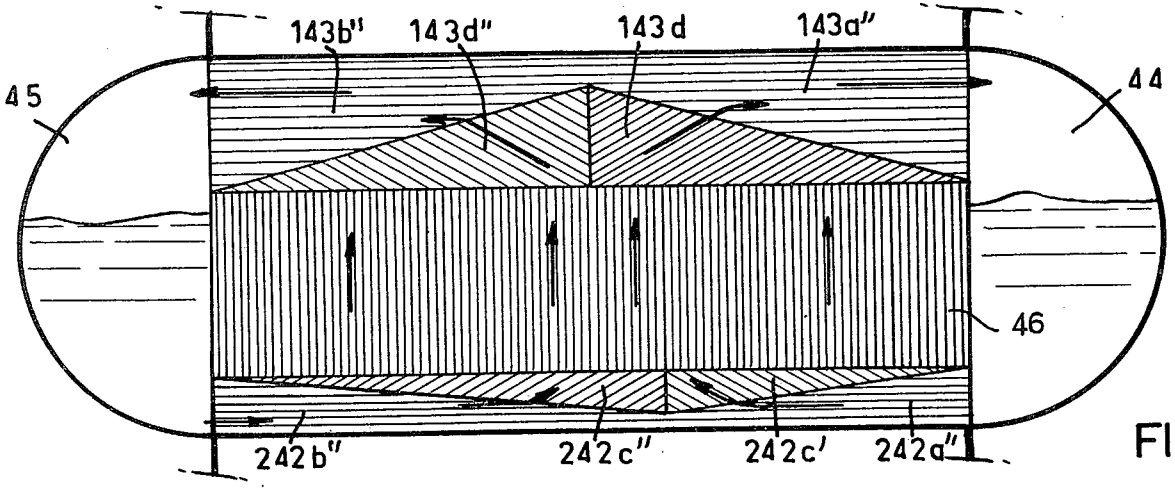

The embodiment according to FIG. 6 differs from the embodiment in FIG. 5 in that the inlet sections 242*b''* and 242*a''* and the connecting sections 242*c'* and 242*c''* are not symmetrical, the sections 242*c''* and 242*b''* having a greater transverse extension than the sections 242*c'* and 242*a''*, in such manner as to distribute the liquid coming from the inlet section 242*b''* along a transverse length greater than half the transverse dimension of the active heat exchange space 46. This allows of an overall flow of liquid from the left towards the right, which is required if the supply of liquid occurs at the left-hand side only.

Figure 7:
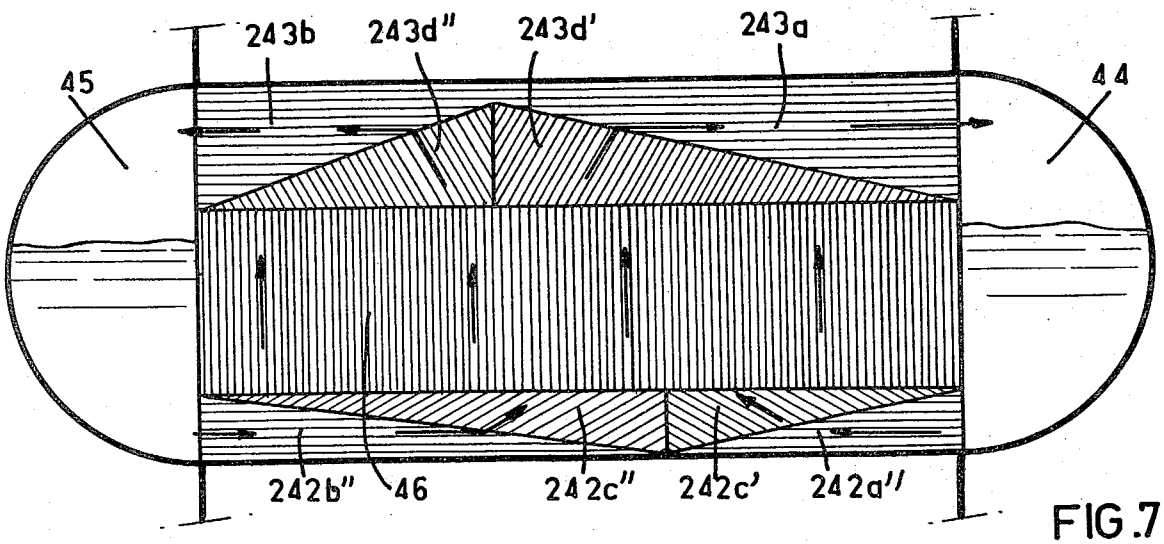

The embodiment according to FIG. 7 differs from the embodiment according to FIG. 6, in that not only are the inlet sections 242*a''*, 242*b''*, 242*c''* and 242*c'* asymmetrical in a direction which corresponds to a greater flow from left to right than in the opposed direction, but equally in that the outlet sections 243*a*, 243*b*, 243*d'* and 243*d''* are asymmetrical, the sections 243*d'* and 243*a* having a greater transverse dimension than the sections 243*d''* and 243*b*, which has the result of increasing the delivery of non-vapourised liquid from left to right, towards the casing 44, as compared to the delivery flowing towards the casing 45.

Figure 8:
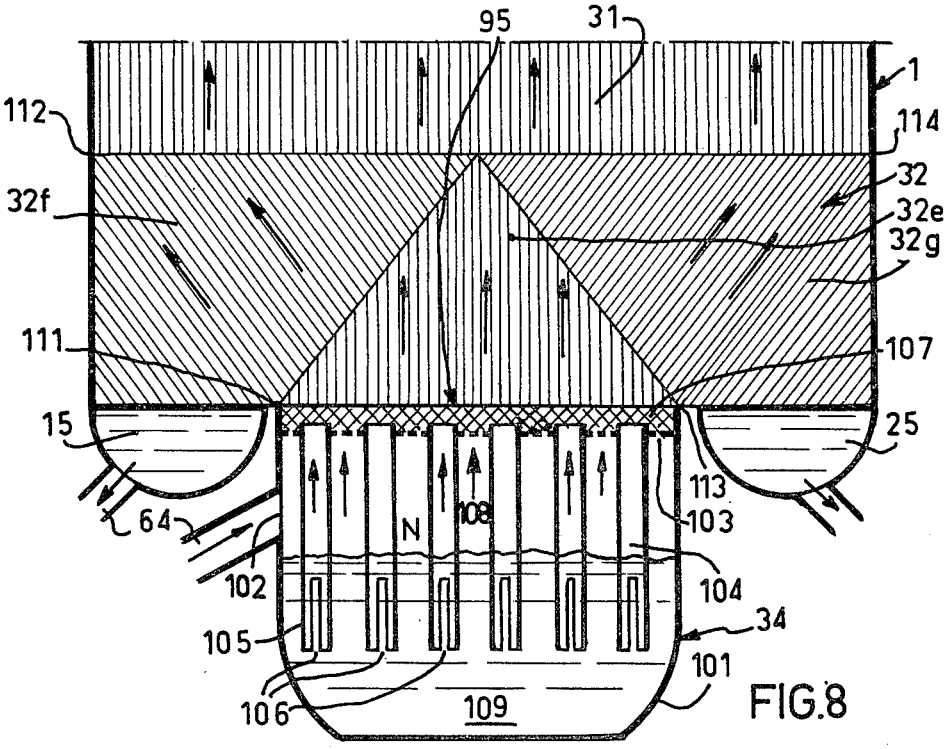
FIGS. 8 and 9 are views in vertical cross-section of two modified embodiments of the lower portion of the heat exchanger abreast of a third passage.

Referring to FIGS. 1 and 8, the arrangement of the two-phase inlet casing 34 which supplies all the third passages 31 for heating the refrigerating mixture, is described in particular for the exchanger 1. As will be apparent from the foregoing, this two-phase inlet casing 34 is installed below the port 95 for supply to the distribution space 32 which has been described previously.

This two-phase supply casing 34 is formed by a casing 101 having a substantial vertical extent, and having an opening 102 at approximately half its height, into which leads the duct for continuous infeed of low-pressure refrigerating mixture 64. Within the casing 101, parallel to the port 95 and a short distance from the latter, is situated a perforated plate 103 on and through which are installed tubes 104 extending below the said plate 103 and to a distance substantially below the opening 102 of the duct 64, the tubes 104 having a lower extremity 105 wherein one or more slots 106 have advantageously been formed. A lining 107 is positioned in the gap between the distribution space 32 and the perforated plate 103.

During operation, the refrigerating mixture which has been expanded by the expansion valve 65 to the low pressure of the cycle, penetrates into the casing 101, in which this fluid in the two-phase state in separated into a vapour fraction 108 and a liquid fraction 109, the normal level of separation N commonly being situated above the slots 106. It will be understood that the propulsive effect caused by the pressure acting on the surface of the liquid mass 109 assures a rise of the liquid through the tubes 104, simultaneously with an escape of the gaseous fraction through the perforations of the plate 103. The two-phase mixture is thus reconstituted in homogenous manner at the upper outlet of the tubes 104, within the lining 107, which allows of a uniform supply to the section **32*e* of the supply space 32. If, for any reason, the delivery of the gaseous phase becomes too great, for example upon starting up or following a breakdown, the level N of the liquid fraction 109 drops until it reaches the level of the slots 106, which then causes the escape of a part of the gaseous fraction via the slots 106 of the tubes 104**. Once the delivery of this liquid fraction, which normally represents the greater part of the two-phase fluid, is re-established, the level N rises again and the operation such as described in the foregoing, is resumed.

Referring to FIG. 8 only at this juncture, the distribution space 32 in this case is formed solely by one section **32*e* in the form of a triangle the height of which corresponds to the longitudinal dimension of the distribution space 32 and the base of which takes up the entire width of the port 95. This section 32*e* has vertical corrugations, and at either side of the section 32*e* are situated two distribution sections 32*f* and 32*g* which take up the remainder of the supply space 32 and which have parallel corrugations which are delimited with respect to the section 32*f*, by the straight line joining the upper left edge 111 of the two-phase supply case 34 to the upper left edge 112 of the supply space 32, and with respect to the section 32*g*, by the straight line which connects the upper right edge 113 of the supply case 34 to the upper right edge 114 of the supply space 32**.

It will thus be understood that the two-phase fluid which flows evenly along the vertical corrugations of the central section **32*e* has half of its quantity taken up by the section 34*f* in case of symmetry, that is if the section 32*e* has the form of an isosceles triangle with an axial apex, and the other half by the section 32*g*, so that the vertical corrugations of the active heat exchange space 36** are supplied uniformly with two-phase liquid.

Figure 10:
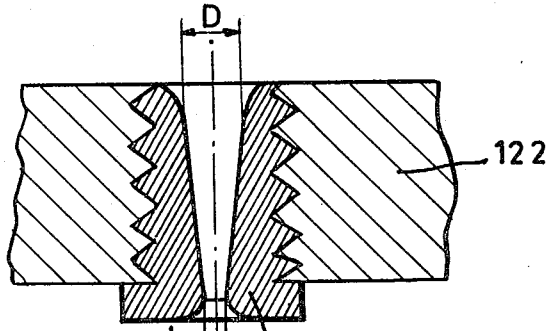
FIG. 10 is a view in vertical cross-section of a detail of FIG. 9.
Figure 9:
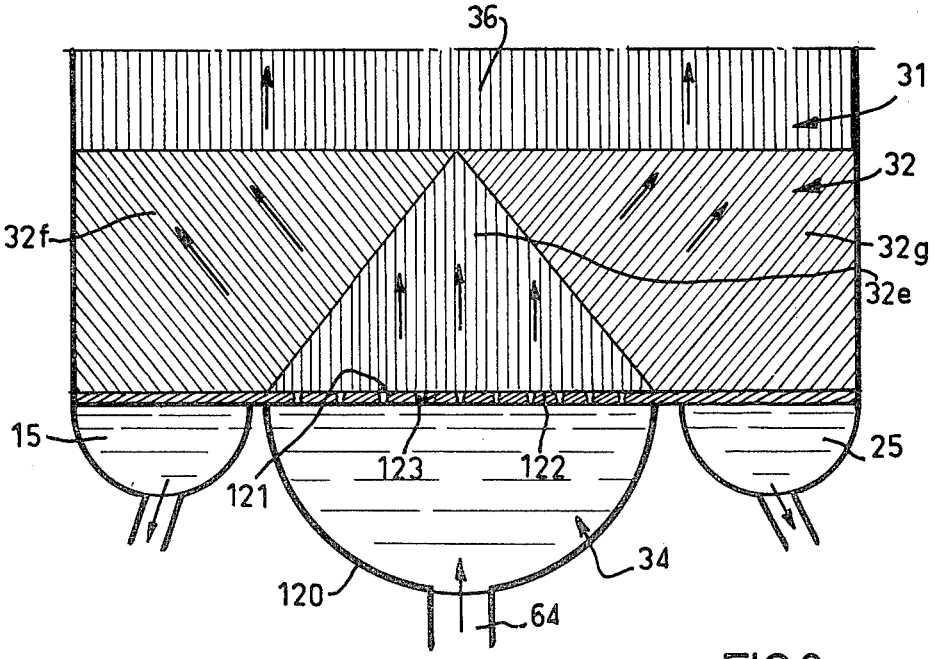

Referring to FIGS. 9 and 10, it is apparent from these that the active heat exchange space 36 of the passages for heating the refrigerating mixture 31 is supplied via a distribution space 32 which is identical to that depicted in FIG. 8, but in this case, the inlet casing 34 is of very different nature: this inlet casing 34 appears in the form of a thick hemispherical vessel 120 installed in alignment with ports 121 for supply to the distribution space 32. Each supply port 121 is covered by a thick plate 122 into which is secured a plurality of ejectors 123 having an upwardly divergent form, the vessel 120 having an intake opening to which is connected the supply pipe 64, but by contrast to the preceding examples, the refrigerating mixture has been expanded in this case to an intermediate pressure such that a liquid only is formed in the vessel 120, the final expansion occurring in the ejectors 123; the two-phase mixture is thus actually produced at the outlet of the ejectors 123 and by this very fact is uniformly distributed along the vertical corrugations of the first section **32*e* of the distribution space 32**.

Figure 11:
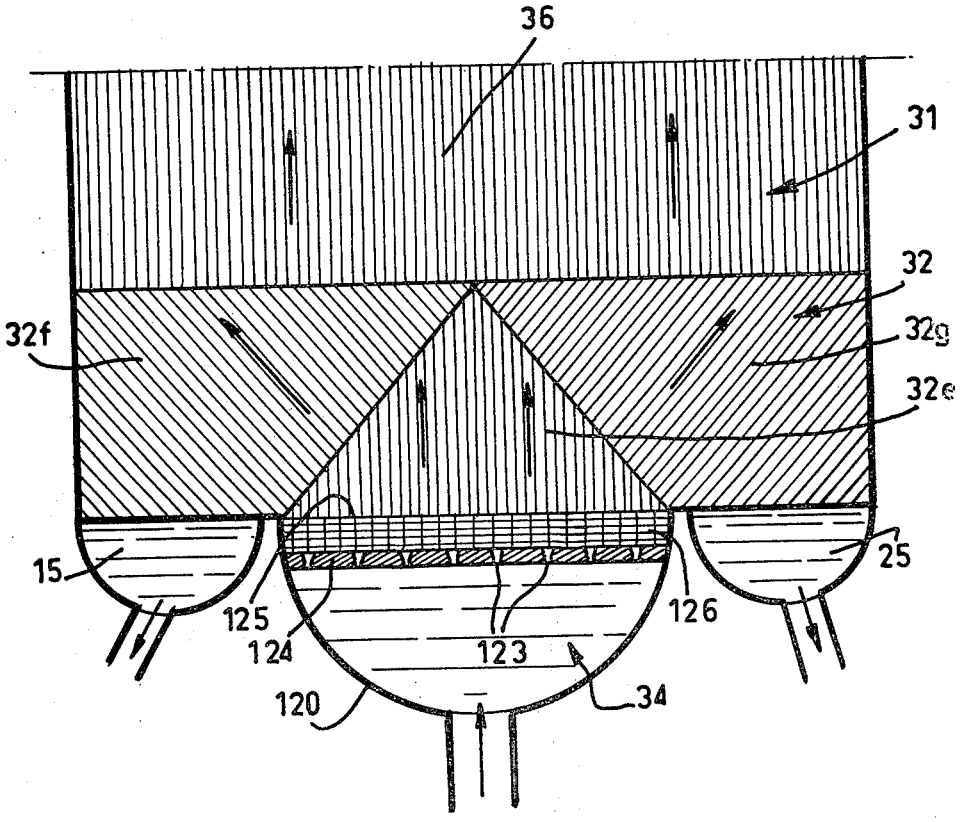
FIG. 11 is a modified version of the arrangement shown in FIG. 9.

Referring to FIG. 11, a description is given of a modified embodiment of the supply casing 34 as described with reference to FIG. 9. Apparent again in this casing is the hemispherical vessel 120 intended to receive the liquid as such at the intermediate pressure, but the ejectors 123 are so arranged in this case in a manner evenly spaced in a bearer plate 124 which extends throughout the surface of the exchanger 1, but at a small distance beyond the exchanger and between the plate 124 and the open ports 125 of the passages 31 for heating the refrigerating mixture, is installed a grating 126 for distribution of two-phase fluid to the inlets of the sections **32*e* of all the distribution spaces 32**.

Figure 13:
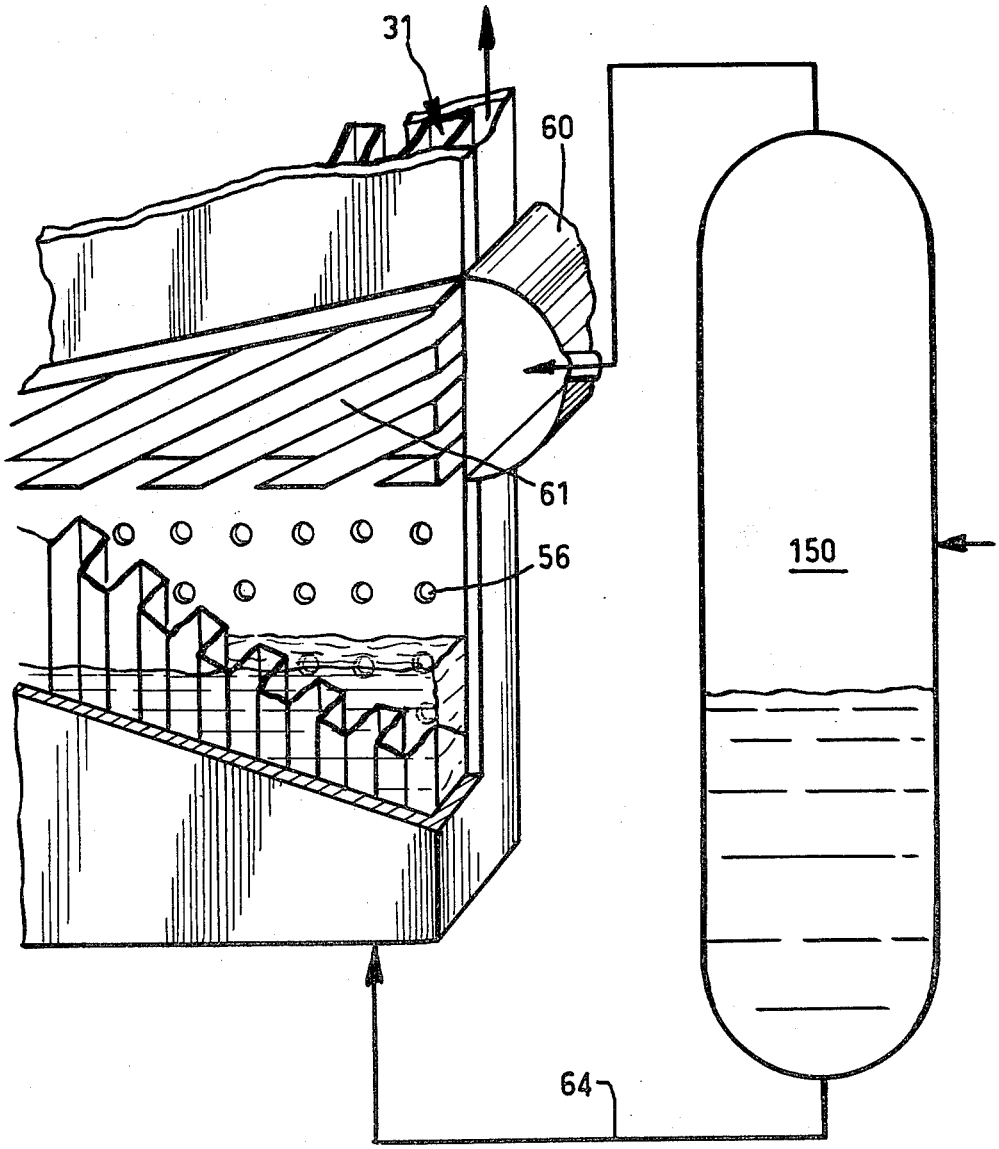
FIG. 13 is a view partially in cross-section and in perspective of a version of the supply of a third passage.
Figure 14:
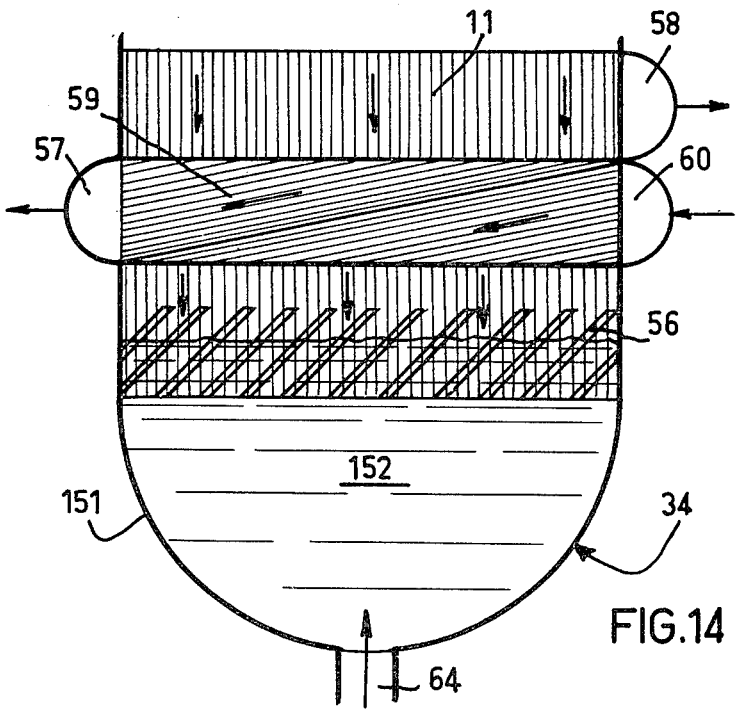
FIGS. 14 and 15 are views in partial and vertical cross-section respectively along the thickness and width of the exchanger.
Figure 15:
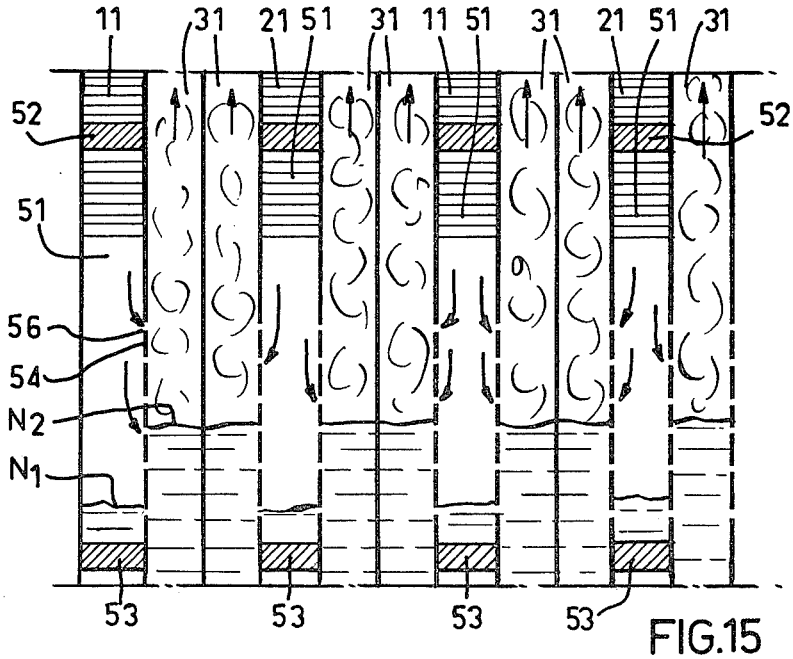

Referring to FIGS. 13, 14 and 15 at this juncture, yet another embodiment of the two-phase supply to the heating ducts 31 for heating the refrigerating mixture is described.

In this case, the supply case 34 comprises a vessel 151 extending throughout the depth of the exchanger 1 and into which is fed liquid 152 after separation in a separator 150 and via the pipe 64. In this case, the passages 31 are arranged side by side in pairs, and within the gap comprised between two pairs of passages 31 is arranged a vapour passage 51 extending along a small terminal length of the exchanger beside its lower extremity or second extremity, which commensurately limits the length of the passages 11 for cooling the refrigerating mixture, and of the passages 21 for cooling the gas processed. The separation between the passages 51 on the one hand and 11 and 21 on the other, is assured by sealing spacers 52.

If applicable, the passages 51 are shut off by bars 53 at the side of the lower extremity of the exchanger 1, and it is apparent that the partitioning plates 54 between each passage 51 and each passage 31 and transpierced along regularly spaced apart sloping slots (or holes) 56.

In this system, the outlets of the passages 11 for cooling the refrigerating mixture and the outlets of the passages for cooling the gas processed are evidently positioned laterally with respect to the exchanger in this case, as denoted at 57 for the passages 11 for refrigerating mixture, or at 58 for the passages for cooling the gas processed. In this case, the discharge distribution space has been simplified so that it makes provision for total discharge of the refrigerating mixture at one side of the exchanger, towards the casing 57 via the distribution space 59, whereas the discharge of the gas processed occurs totally at the other side towards the casing 58 of the exchanger. It will be noted that the outlet casing 57 and 58 are longitudinally staggered, in such manner as to form a free space for incorporation of an inlet casing 60 coordinated with a distribution space 61, for the vapour phase coming from the separator 150, whereas the liquid 152 is drawn off into a tank from this separator 150 itself.

During operation, it will be understood that the vapour which penetrates into the passages 51 undergoes a definite pressure loss in the apertures 56, so that the liquid level $N_1$ established in the passages 51 is lower than the liquid level $N_2$ established in the passages 31 for heating the refrigerating mixture. The vapour consequently penetrates uniformly into the slots 56 and is thus distributed into the liquid. The essential advantage of this system is that the two-phase mixture is formed just upstream of the heat exchange space between the passages 11 for cooling the refrigerating mixture and 21 for the gas processed.

Figure 16:
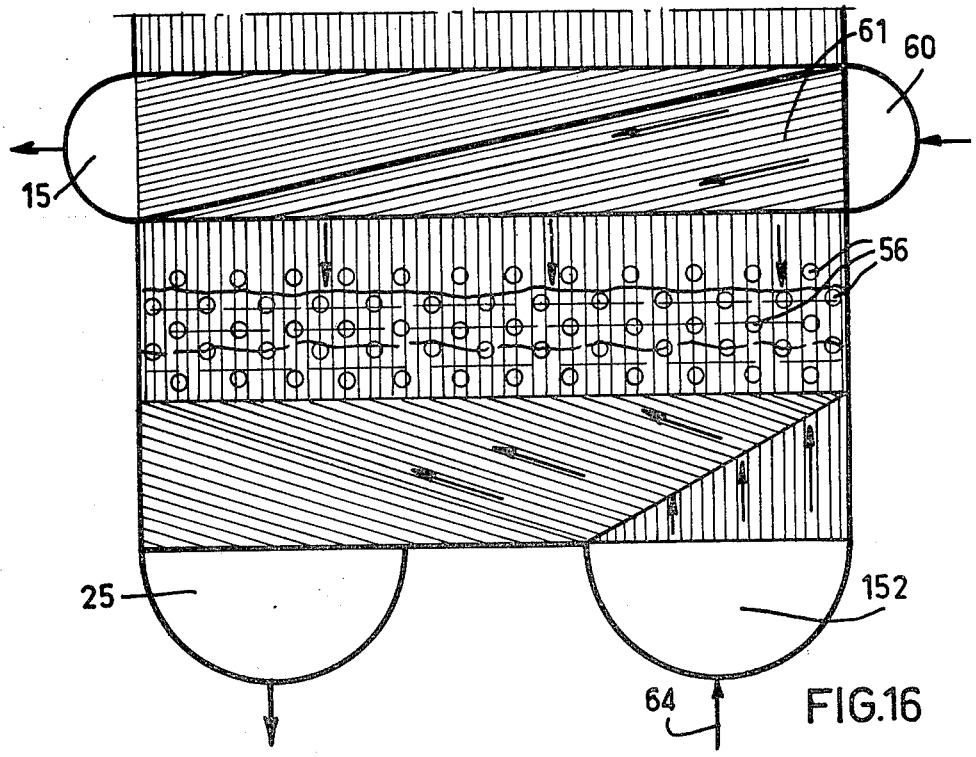
FIGS. 16 and 17 are views analogous to those of FIGS. 14 and 15 of another modified embodiment.
Figure 17:
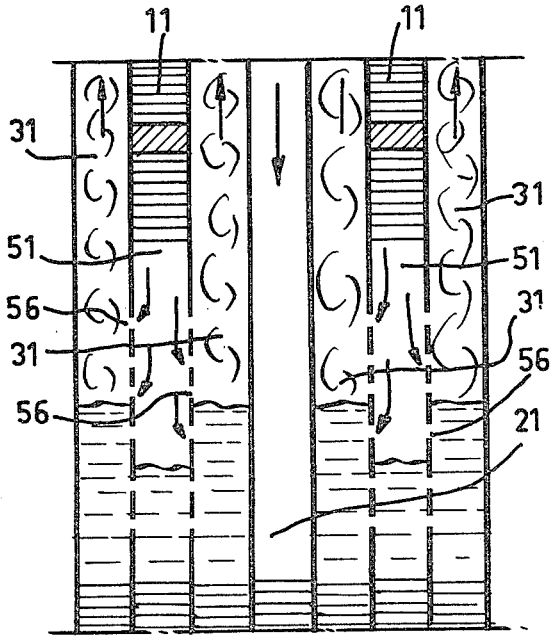

Referring to the modified embodiment illustrated in FIGS. 16 and 17, an arrangement is shown therein which is substantially analogous to the passages 31 for heating refrigerating mixture 31 which are situated at either side of a vapour passage 51 which is itself situated in the longitudinal extension of the passages 11 for cooling refrigerating mixture, whereof the outlet casing 15 is arranged laterally. By contrast, the passages 21 for processed gas extend in this instance throughout the length of the exchanger 1, and the outlet casing 25 is then situated at the end of the exchanger. The passages 21 for processed gas lead to an end outlet casing 25.

Figure 18:
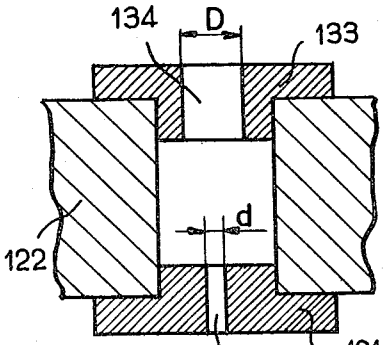

Referring to FIG. 18 showing a modified embodiment as compared to FIG. 10, an ejector is formed in this case by two elements secured on the plate 122, being an upstream element 131 pierced by a passage 132 having a diameter d and a downstream element 133 pierced by a passage 134 having a diameter D. The cross-sectional area of the passage D is equal to 1.5 to 5 times the cross-sectional area of the passage d, advantageously from 2 to 4 times greater and preferably of the order of 3 times greater. This system allows of flexibility of control rendering it possible to have a constant expansion pressure downstream for rates of delivery varying within wide limits, for example from 40% to 120% with upstream pressures which likewise differ considerably.

Figure 19:
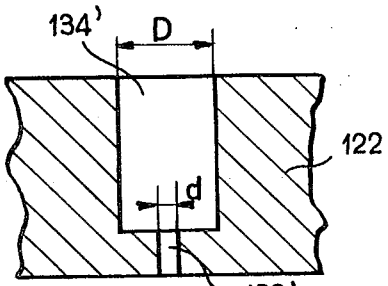
FIGS. 18 and 19 are views of two modifications of the arrangement shown in FIG. 10.

FIG. 19 shows a modification of the embodiment of FIG. 18 in which the passages 132' and 134' are formed direct in the plate 122.

We claim:

1. In a plate-type heat exchanger comprising a plurality of rectangular plates stacked and joined together with sealed mutual spacing along the thickness of the exchanger to form at least:

(a) a plurality of first passages for the cooling of a refrigerating mixture;

(b) a plurality of second passages for the cooling of a gas which is to be processed, said first and second passages having inlets at a first longitudinal extremity of the exchanger and outlets at least close to a second longitudinal extremity of the exchanger;

(c) a plurality of third passages for heating the refrigerating mixture having outlets which are laterally situated at a distance from said first extremity of the exchanger; and (d) a plurality of fourth passages arranged in longitudinal extensions left free by said third passages, extending longitudinally from the outlet extremity of said third passages to said first extremity of the exchanger, the inlets and outlets of said fourth passages being situated laterally with respect to the exchanger;

the improvement in which said fourth passages have active heat exchange spaces comprising flow-guiding means directed longitudinally of the exchanger whose longitudinal extent is limited, thereby leaving free at either longitudinal side of said active space on the one hand a supply distribution space comprising flow-guiding means, and on the other hand a discharge distribution space comprising flow-guiding means, said supply and discharge flow-guiding means leading respectively into the inlets and outlets of said fourth passages, said inlets and outlets of said fourth passages being so disposed that fluid flows in said fourth passages toward said first longitudinal extremity of the exchanger.

2. A heat exchanger according to claim 1, wherein said supply distribution spaces and said discharge distribution spaces each comprising flow-guiding means, comprise at least one section comprising flow-guiding means directed transversely with respect to the length of the exchanger.

3. A heat exchanger according to claim 2, wherein said sections comprising flow-guiding means directed transversely with respect to the exchanger are immediately adjacent to the active heat exchange space, said heat exchange space having a greater longitudinal extent close to the centre of the exchanger than at the periphery of the exchanger.

4. A heat exchanger according to claim 2, wherein at least one connecting space comprising flow-guiding means directed towards said active heat exchange space is situated between said distribution spaces comprising flow-guiding means directed transversely with respect to the length of the exchanger and said active heat exchange space.

5. A heat exchanger according to claim 1, wherein said longitudinal extent of a said discharge distribution space is greater than the longitudinal extent of a said supply distribution space, lengthwise of the exchanger.

6. A heat exchanger according to claim 1, wherein each said fourth passage has two inlets and two outlets at either lateral side of the exchanger and wherein said supply distribution spaces and said discharge distribution spaces are formed by two sections of flow-guiding means each leading to a particular inlet and particular outlet respectively, and adjacent to the inside of the exchanger.

7. A heat exchanger according to claim 6, wherein a section of said flow-guiding means associated with an inlet (or with an outlet) has the same extent transversely with respect to the exchanger as the other section of said flow-guiding means associated with the other inlet (or outlet) respectively.

8. A heat exchanger according to claim 7 wherein a section of said flow-guiding means of a said discharge distribution space has a smaller transverse extent than that of the other discharge distribution section of said flow-guiding means, the section comprising flow-guiding means for discharge which has the smallest transverse extent having an outlet which is situated at the same lateral side as the inlet of said supply distribution section comprising flow-guiding means and having the greatest transverse extent.

9. A heat exchanger according to claim 6, wherein a section of said flow-guiding means of a said supply distribution space has a greater transverse, extent than that of the outer section of flow-guiding means of said supply distribution space.

10. A heat exchanger according to claim 1, wherein a plurality of said fourth passages in the form of a plurality of groups of sub-passages is situated along the length of the exchanger, said fourth sub-passages situated at the same longitudinal level being connected to common inlet-outlet casings.

11. A heat exchanger according to claim 10, wherein said auxiliary passages of said third type are arranged in at least one of said extension of said first passages and said extension of said second passages, themselves terminating at a distance from said second extremity via lateral outlets.

12. A heat exchanger according to claim 1, wherein said third passages have, adjacent said second extremity of the exchanger, supply distribution spaces and to a supply casing.

13. A heat exchanger according to claim 12, wherein said supply distribution spaces comprise an upstream section which co-extends transversely of said supply casing and has a triangular shape, the flow-guiding means of said unflow section being directed longitudinally of the exchanger.

14. A heat exchanger according to claim 13, wherein the upstream section of said distribution space has a longitudinal extent equal to that of said distribution space and said upstream distribution section is followed by two connecting sections comprising sloping flow-guiding means.

15. A heat exchanger according to claim 13, wherein said upstream section of said distribution space has a smaller longitudinal extent than the longitudinal extent of said distribution space and comprises two intermediate connecting sections leading to a downstream section of triangular form having the same apex as said upflow section, and the base of which corresponds to the transverse extent of a said third passage, said downstream section having flow-guiding means which extend longitudinally of the exchanger.

16. A heat exchanger according to claim 12, wherein said casing supply case for said third passages comprises means of delivering a composite fluid comprising a liquid phase and a vapour phase, which are uniform along each transverse extent of a said passage and from on passage to the next along the thickness of the exchanger.

17. A heat exchanger according to claim 16, wherein said delivery means comprise a casing at the end of the exchanger extending throughout the thickness of the exchanger and at a small distance from the second extremity of the exchanger incorporating a plate having perforations supporting tubes extending longitudinally in the said casing, said tubes being slotted at their free extremity, a lining means being interposed between the inlets of said third passages and said perforated plate.

18. A heat exchanger according to claim 16, wherein said supply casing comprises a vessel for a liquid phase and a plate comprising expansion ejectors distributed evenly along the transverse extent of each said inlet of said third passages.

19. A heat exchanger according to claim 17, wherein said plate comprising ejectors is a single plate having ejectors distributed about the surface thereof, situated at a small distance from the inlets of said third passages, the interstitial space between said inlets and said plates bearing the aforesaid nozzles being filled with a lining.

20. A heat exchanger according to claim 15, wherein said means of delivering a fluid into said third passages incorporate a liquid phase supply casing installed at the end of the second extremity of the exchanger and auxiliary passages of said third type in communication via distributed perforations with said third passages, said auxiliary passages being supplied with vapour phase.

21. A heat exchanger according to claim 1, wherein said flow-guiding means comprise corrugated material.

22. A heat exchanger according to claim 1, in which said longitudinal dimension extends vertically.

23. A heat exchanger according to claim 22, in which said first longitudinal extremity of the exchanger is uppermost.

* * * * *